US010383781B2

(12) United States Patent
Wang

(10) Patent No.: US 10,383,781 B2
(45) Date of Patent: Aug. 20, 2019

(54) NURSING BED

(71) Applicant: Xiading Wang, Fuzhou (CN)

(72) Inventor: Xiading Wang, Fuzhou (CN)

( * ) Notice: Subject to any disclaimer, the term of this patent is extended or adjusted under 35 U.S.C. 154(b) by 368 days.

(21) Appl. No.: 15/166,234

(22) Filed: May 26, 2016

(65) Prior Publication Data

US 2016/0270992 A1 Sep. 22, 2016

Related U.S. Application Data

(63) Continuation-in-part of application No. PCT/CN2014/092442, filed on Nov. 28, 2014.

(30) Foreign Application Priority Data

Nov. 29, 2014 (CN) ..... 2013 1 0628493

(51) Int. Cl.

| | |
|---|---|
| ***A61G 7/05*** | (2006.01) |
| ***A47C 23/18*** | (2006.01) |
| ***A61G 7/015*** | (2006.01) |
| ***A61G 7/047*** | (2006.01) |
| *A61G 7/018* | (2006.01) |

(52) U.S. Cl.

CPC ..... *A61G 7/05* (2013.01); *A47C 23/18* (2013.01); *A61G 7/015* (2013.01); *A61G 7/047* (2013.01); *A61G 7/018* (2013.01)

(58) Field of Classification Search

CPC . A61G 7/02; A61G 7/05; A61G 7/047; A61G 7/015; A61G 7/018; A47C 23/18

See application file for complete search history.

(56) References Cited

U.S. PATENT DOCUMENTS 3,701,170 A * 10/1972 Bond ..... A47K 3/001 4/570
4,052,243 A * 10/1977 Yazawa ..... D04H 3/04 128/100.1
4,982,462 A * 1/1991 Wada ..... A61G 7/0005 4/546
5,023,967 A * 6/1991 Ferrand ..... A61G 7/00 5/185
5,101,519 A * 4/1992 Yamamoto ..... A61G 7/00 4/300
5,355,540 A * 10/1994 Allen ..... A61G 7/0005 4/547

(Continued)

*Primary Examiner* — Robert G Santos
*Assistant Examiner* — David R Hare
(74) *Attorney, Agent, or Firm* — Matthias Scholl, PC; Matthias Scholl

(57) ABSTRACT

A nursing bed including a bed frame; a net-shaped fabric; a spray pipe; a heat-insulation and water-draining bottom cover; a base; an auxiliary load-bearing layer; and an auxiliary load-bearing frame. The heat-insulation and water-draining bottom cover is disposed at the lower part of the bed frame. At least two edges of the net-shaped fabric are hung between two opposite edges of the bed frame to form a mutual positioning structure. The auxiliary load-bearing layer is disposed beneath the net-shaped fabric. The grid support comprises a grid supporting surface beneath the net-shaped fabric, and the grid line width of the grid supporting surface is between 0.3 and 3 mm. The diameter of an inscribed circle of the holes is between 5 and 60 mm. The distance between the net-shaped fabric and the grid supporting surface exceeds 15 mm in an empty load state.

12 Claims, 5 Drawing Sheets

(56) References Cited

U.S. PATENT DOCUMENTS

| | | | | |
|---|---|---|---|---|
| 5,598,592 | A * | 2/1997 | Castellani | A61G 1/013 5/625 |
| 8,615,832 | B2 * | 12/2013 | Wang | A47C 23/18 5/724 |
| 8,745,798 | B2 * | 6/2014 | Wang | A47C 23/18 5/724 |
| 8,914,924 | B2 * | 12/2014 | Stryker | A61G 7/001 5/600 |
| 8,935,821 | B2 * | 1/2015 | Obriot | A47D 7/007 5/652.1 |
| 9,066,839 | B2 * | 6/2015 | Al-Madi | A61G 7/0005 |
| 9,375,375 | B2 * | 6/2016 | Wang | A61G 7/0573 |
| 2010/0313357 | A1 * | 12/2010 | Chang | A61G 7/0005 5/604 |

* cited by examiner

NURSING BED

CROSS-REFERENCE TO RELATED APPLICATIONS

This application is a continuation-in-part of International Patent Application No. PCT/CN2014/092442 with an international filing date of Nov. 28, 2014, designating the United States, now pending, and further claims priority benefits to Chinese Patent Application No. 201310628493.9 filed Nov. 29, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a nursing bed.

Description of the Related Art

Typically, a nursing bed includes a net-shaped fabric having a warp and a weft which are uniformly distributed. If the patients change postures from lying to sitting, the weight supported by the warp and the weft beneath the hip increases by several times, and thus the warp and the weft are prone to plastic elongation, thereby destroying the net-shaped fabric and deforming the bed body.

SUMMARY OF THE INVENTION

In view of the above-described problems, it is one objective of the invention to provide a nursing bed that has a semiautomatic washing function, and can maintain the shape thereof and protect the net-shaped fabric from damage even after a long term of use.

To achieve the above objective, in accordance with one embodiment of the invention, there is provided a nursing bed comprising a bed frame; a net-shaped fabric; a spray pipe; a heat-insulation and water-draining bottom cover; a base; an auxiliary load-bearing layer comprising a plurality of holes; and an auxiliary load-bearing frame. The heat-insulation and water-draining bottom cover is disposed at a lower part of the bed frame; at least two edges of the net-shaped fabric are hung between two opposite edges of the bed frame to form a mutual positioning structure; the auxiliary load-bearing layer is disposed beneath the net-shaped fabric; the grid support comprises a grid supporting surface beneath the net-shaped fabric; a grid line width of the grid supporting surface is between 0.3 and 3 mm; a diameter of an inscribed circle of the holes is between 5 and 60 mm; the auxiliary load-bearing layer is disposed inside the auxiliary load-bearing frame and is located at an inner side of the bed frame via the auxiliary load-bearing frame; the auxiliary load-bearing frame and the bed frame coordinate to form a spacing-adjustable positioning structure; and a distance between the net-shaped fabric and the grid supporting surface exceeds 15 mm in an empty load state.

The region of the heat-insulation and water-draining bottom cover where the hip is laid is designed to be hollow funnel-shaped, the lowest part of which is provided with a drainage hole. The heat-insulation and water-draining bottom cover comprises a reinforced layer, an insulation material layer, and a waterproof layer on the inner surface. The insulation material layer comprises closed space contacting with patients, and a constant temperature and humidity device is disposed in the closed space to supply constant temperature and humidity conditions.

In a class of this embodiment, the auxiliary load-bearing layer comprises a rigid body and an elastic body, and the plurality of holes of the auxiliary load-bearing layer are in the shape of an inverted cone with a relatively large upper part and a relatively small lower part.

In a class of this embodiment, an edge of the rigid body of the auxiliary load-bearing layer is provided with a hanging hole. The auxiliary load-bearing frame is provided with a hanging column. The auxiliary load-bearing layer is mounted on the hanging column of the auxiliary load-bearing frame via the hanging hole. To ensure that the auxiliary load-bearing layer matches the lying or sitting postures of humans, the hanging column of the auxiliary load-bearing frame is independently adjustable in a vertical direction relative to the auxiliary load-bearing frame, and a vertical displacement of the hanging column is less than or equal to 7 cm.

In a class of this embodiment, the grid support of the auxiliary load-bearing layer comprises stainless steel wires equally spaced in length and breadth and stop boards; the stainless steel wires pass through openings of the stop boards to connect to one end of a spring, and the other end of the spring is fixed on the auxiliary load-bearing frame; a distance between the stop boards and the auxiliary load-bearing frame is adjustable, and the stop boards and the auxiliary load-bearing frame can be fixed in a preset position.

To directly observe a hanging angle of the auxiliary load-bearing layer, an outer vertical surface of the auxiliary load-bearing frame is provided with an indicator that is capable of synchronously moving with the hanging column. Because of the large pressure imposed on the net-shaped fabric corresponding to the area from shoulder to knee of a patient, the auxiliary load-bearing layer and the auxiliary load-bearing frame are arranged beneath the corresponding region, or beneath a region where the hip is laid. A length of the auxiliary load-bearing layer and the auxiliary load-bearing frame is less than 60% of a total length of the nursing bed.

In a class of this embodiment, a maximum vertical displacement of the auxiliary load-bearing frame is less than or equal to 8 cm.

In a class of this embodiment, the net-shaped fabric comprises a warp and a weft, and the warp and the weft are interwoven to form mesh openings; a diameter of the mesh openings or a diameter of an inscribed circle of the mesh openings is between 2 and 6 folds of a diameter of the warp or the weft; the diameter of the warp or the weft is less than 0.55 mm; the diameter of the mesh openings or the diameter of the inscribed circle of the mesh openings is less than 1.5 mm; an area of an opening of each mesh opening accounts for between 35% and 78% of a total area of the mesh opening; a thickness of the net-shaped fabric is less than 1.1 mm.

The net-shaped fabric is interwoven by a single warp and weft. To prolong the service life of the net-shaped fabric, the warp and weft are bound together. However, the diameter of the warp and the weft is less than 0.55 mm and an area of an intersection of the warp and the weft is very small, the bond of the warp and the weft is unfirm and easily loose. Herein the binding means of the invention is as follows.

Interwoven strips are formed on the net-shaped fabric along the direction of the warp and/or the direction of the weft by congested warps or wefts. Each of the interwoven strips comprises between 2 and 5 warps or wefts. The interwoven strips are uniformly distributed on the net-shaped fabric in a comb-like manner or a grid-like manner. A minimum space between two adjacent interwoven strips is 3 mm, and a maximum space between two adjacent interwoven strips is 50 mm. Because the radial section of the warp or the weft is round in shape or approximately round in shape, the surface of the interwoven strips formed by dense warp and weft comprises grooves. The grooves are filled with a waterproof adhesive for the purpose of firm adhesion. The grid-like adhesion ensures that the disconnection of the warp or the weft only occurs in one grid formed by interwoven strips, so that the durability of the net-shaped fabric is highly improved.

A pipe slot is disposed on the bed frame or the auxiliary load-bearing frame. A spray pipe is disposed between the net-shaped fabric and the auxiliary load-bearing layer in the pipe slot. The spray pipe is hidden inside the pipe slot in an idle state.

When the nursing bed is loaded, the weight exerted on the net-shaped fabric is passed on to the bed frame, and the weight exerted on the auxiliary load-bearing layer is passed on to the auxiliary load-bearing frame. The net-shaped fabric hung on the bed frame produces elastic stretch due to the body weight. When the stretch length exceeds the preset value, the net-shaped fabric contacts with the auxiliary load-bearing layer disposed therebelow, so the auxiliary load-bearing layer shares the body weight, and the net-shaped fabric is prevented from being stretched longer. The distance between the net-shaped fabric and the auxiliary load-bearing layer is adjustable, so that the preset value of the stretch length of the net-shaped fabric can be modified accordingly.

For the nursing bed of the invention, the net-shaped fabric and the auxiliary load-bearing layer jointly support the body weight of patients, which is an essential distinction from conventional nursing beds.

The nursing bed of the invention is not allowed to use in the following working condition: when the patient lies on the nursing bed and the distance between the net-shaped fabric and the auxiliary load-bearing layer is too small, the net-shaped fabric bears non or only a small portion of the weight of the patient, so that almost no elastic stretch is produced by the net-shaped fabric. In such condition, the whole or most weight of the patient is imposed on the auxiliary load-bearing layer. Because the auxiliary load-bearing layer comprises the holes of large sizes, the skin and flesh of the body are trapped in the hole, thereby being harmful to the patient body after a long term of such a working condition.

BRIEF DESCRIPTION OF THE DRAWINGS

The invention is described hereinbelow with reference to the accompanying drawings, in which.

Figure 1:
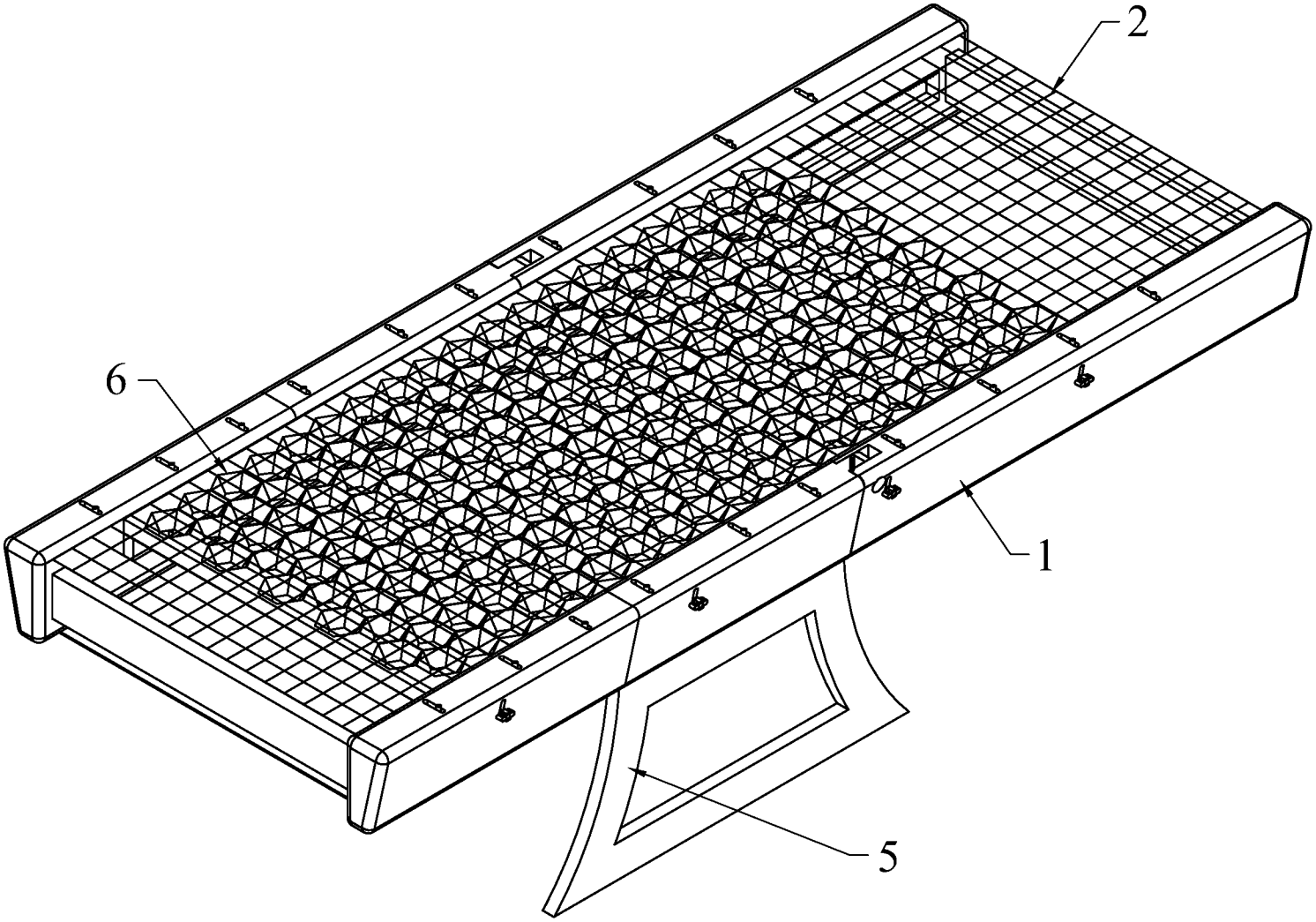
FIG. 1 is a structure diagram of a nursing bed in accordance with one embodiment of the invention.

In the drawings, the following reference numbers are used:

1. Bed frame;
2. Net-shaped fabric;
21. Warp and weft;
22. Mesh opening;
23. Interwoven strip;
3. Spray pipe;
31. Pipe slot;
4. Heat-insulation and water-draining bottom cover;
5. Base;
6. Auxiliary load-bearing layer;
61. Auxiliary load-bearing frame;
62. Mesh opening;
63. Rigid body;
64. Elastic body;
65. Hanging column;
66. Stainless steel wire;
67. Stop board;
68. Spring;
D. Grid line width.

DETAILED DESCRIPTION OF THE EMBODIMENTS

For further illustrating the invention, experiments detailing a nursing bed are described below. It should be noted that the following examples are intended to describe and not to limit the invention.

Example 1

Figure 2:
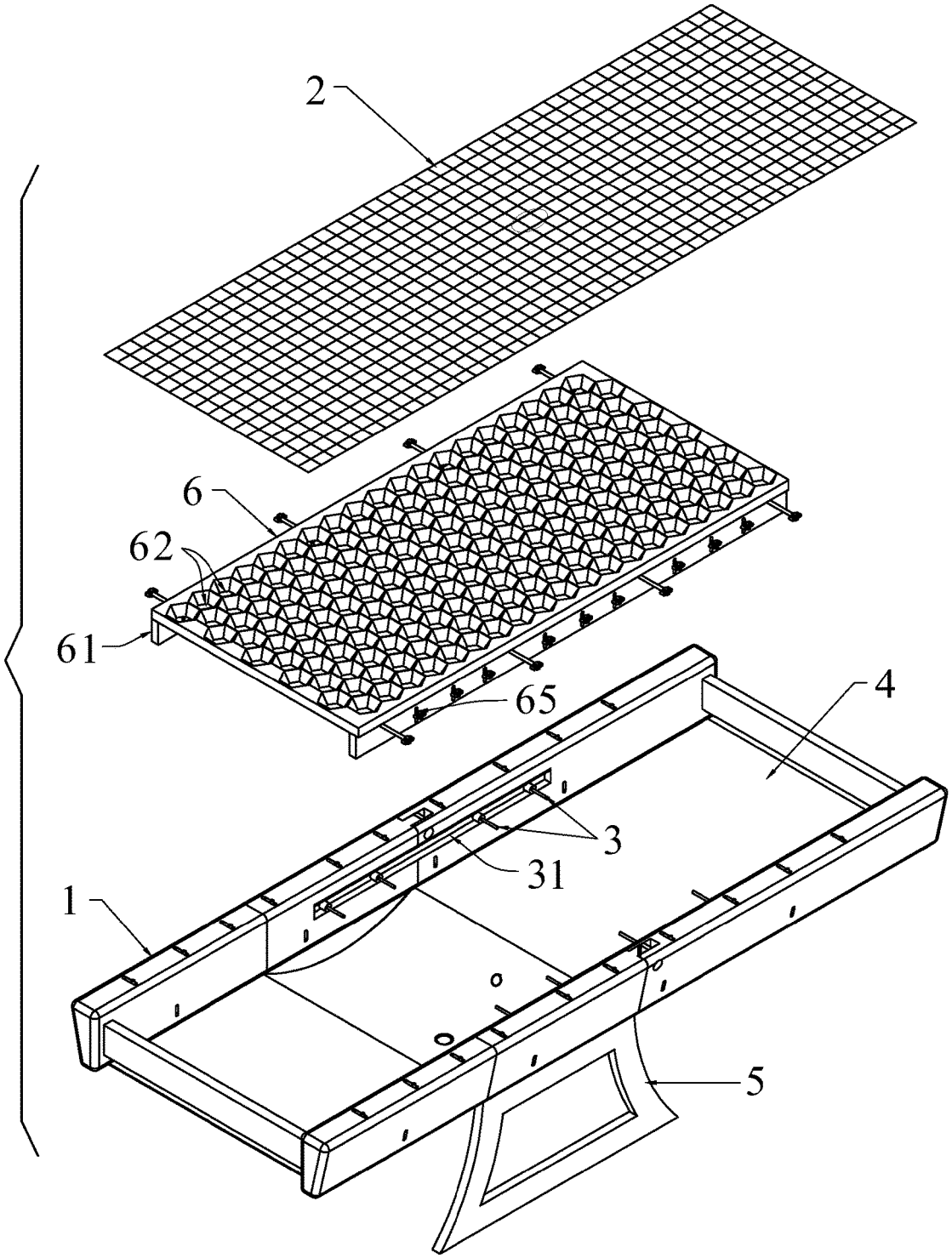
FIG. 2 is an exploded view of a nursing bed in accordance with one embodiment of the invention.
Figure 3:
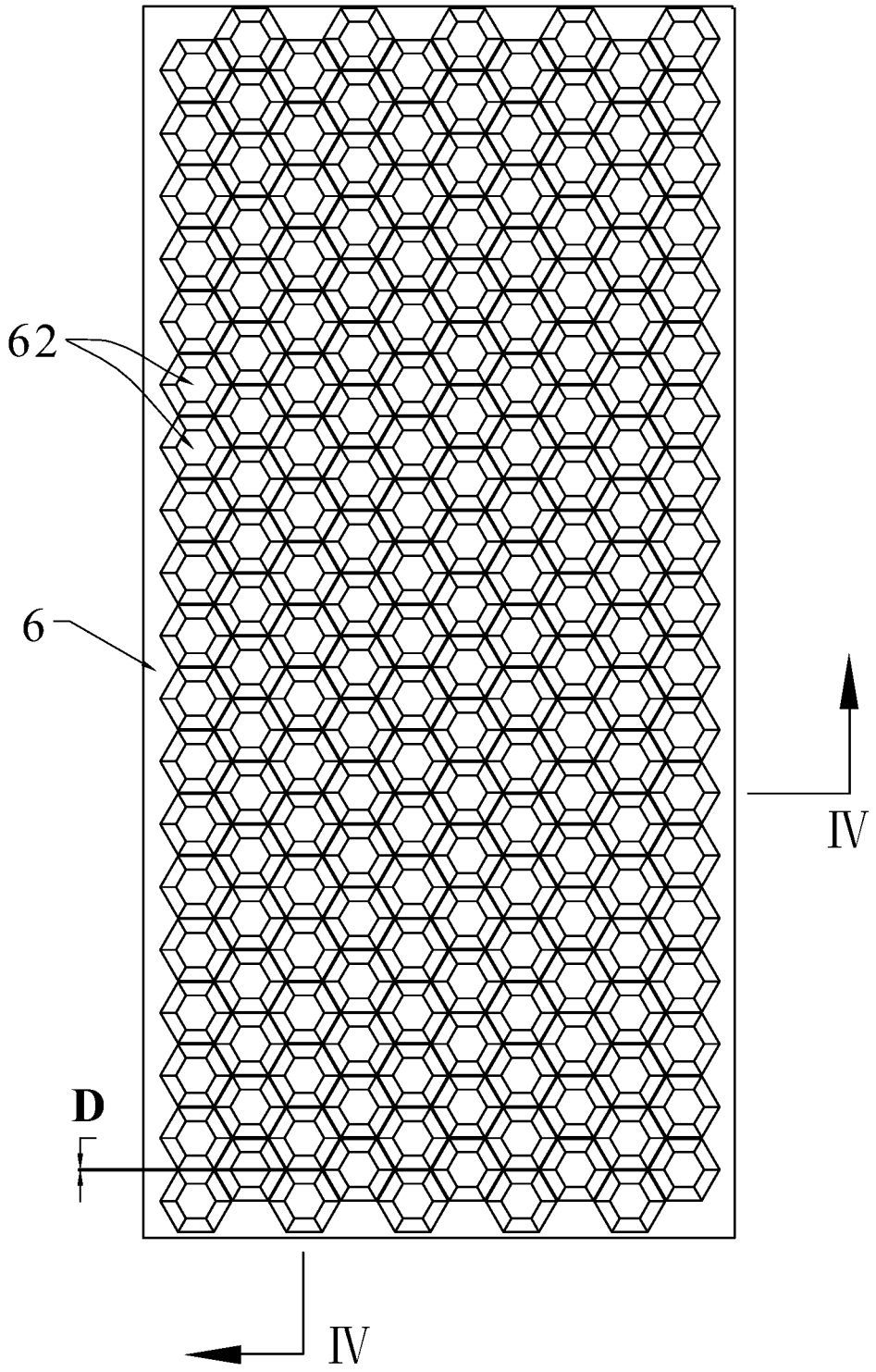
FIG. 3 is a structure diagram of an auxiliary load-bearing layer in accordance with one embodiment of the invention.
Figure 4:
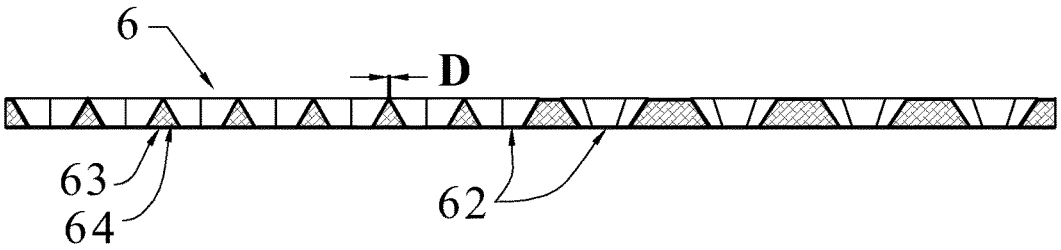
FIG. 4 is a cross sectional view taken from line IV-IV of FIG. 3.

As shown in FIGS. 1 and 2, a nursing bed comprises: a bed frame 1; a net-shaped fabric 2; a spray pipe 3; a heat-insulation and water-draining bottom cover 4; a base 5; an auxiliary load-bearing layer 6. Herein the base 5 is in the form of supporting legs, or a bottom of each of the supporting legs is provided with a roller for pushing the nursing bed forward.

The heat-insulation and water-draining bottom cover 4 is disposed at the lower part of the bed frame 1. At least two edges of the net-shaped fabric 2 are hung between two opposite edges of the bed frame 1 to form a mutual positioning structure. Specifically, the relatively longer edges of the net-shaped fabric 2 are fixed on the bed frame 1 by the hanging structure. The auxiliary load-bearing layer 6 is disposed beneath the net-shaped fabric 2. A pipe slot 31 is disposed on the bed frame 1 or the auxiliary load-bearing frame 61. A spray pipe 3 is disposed between the net-shaped fabric 2 and the auxiliary load-bearing layer 6 in the pipe slot 31; and the spray pipe 3 is hidden inside the pipe slot 31 in an idle state. In operation, the spray pipe 3 extends out of the pipe slot 31 and swings in a shape of a sector in a horizontal direction, and a swing angle is less than or equal to 170°. During swinging, the spray pipe 3 sprays water to wash a lower surface of the net-shaped fabric 2 and an upper surface of the auxiliary load-bearing layer 6 from different directions. During the washing, the body posture of the patient is required to change. When the patient is turned leftward, the lower surface of the net-shaped fabric 2 and the upper surface of the auxiliary load-bearing layer 6 in the middle region and the right side of the bed are washed. When the patient is turned rightward, the lower surface of the net-shaped fabric 2 and the upper surface of the auxiliary load-bearing layer 6 in the middle region and the left side of the bed are washed.

As shown in FIGS. 1-4, the auxiliary load-bearing layer 6 comprises a rigid body 63, an elastic body 64, and a plurality of holes 62. An outer side of the elastic body 64 is wrapped with a waterproof and anti-fouling surface layer. Each of the holes 62 of the auxiliary load-bearing layer 6 is in the form of an inverted cone structure with a relatively large upper part and a relatively small lower part. A diameter of an inscribed circle of the holes 62 is between 5 and 60 mm. The elastic body 63 separated by the holes 62 forms a grid supporting surface beneath the net-shaped fabric 2. A grid line width D of the grid supporting surface facing the net-shaped fabric is between 0.3 and 3 mm. The auxiliary load-bearing layer 6 is disposed inside an auxiliary load-bearing frame 61 and is located at an inner side of the bed frame 1 by the auxiliary load-bearing frame 61. The auxiliary load-bearing frame 61 and the bed frame 1 form a spacing-adjustable positioning structure. A distance between the net-shaped fabric 2 and the grid supporting surface exceeds 15 mm in an empty load state.

Specifically, an edge of the rigid body 63 of the auxiliary load-bearing layer 6 is provided with a hanging hole. The auxiliary load-bearing frame 61 is provided with a hanging column 65. The auxiliary load-bearing layer 6 is mounted on the hanging column 65 of the auxiliary load-bearing frame 61 via the hanging hole. The hanging column 65 of the auxiliary load-bearing frame 61 is independently adjustable in a vertical direction relative to the auxiliary load-bearing frame 61, and a vertical displacement of the hanging column 65 is less than or equal to 7 cm.

The auxiliary load-bearing frame 61 and the bed frame 1 form a spacing-adjustable positioning structure, and a maximum vertical displacement of the auxiliary load-bearing frame 61 is less than or equal to 8 cm. Thus, a distance between the auxiliary load-bearing frame 61 and the net-shaped fabric 2 is adjusted according to personal habit or the requirement from the doctor.

Figure 5:
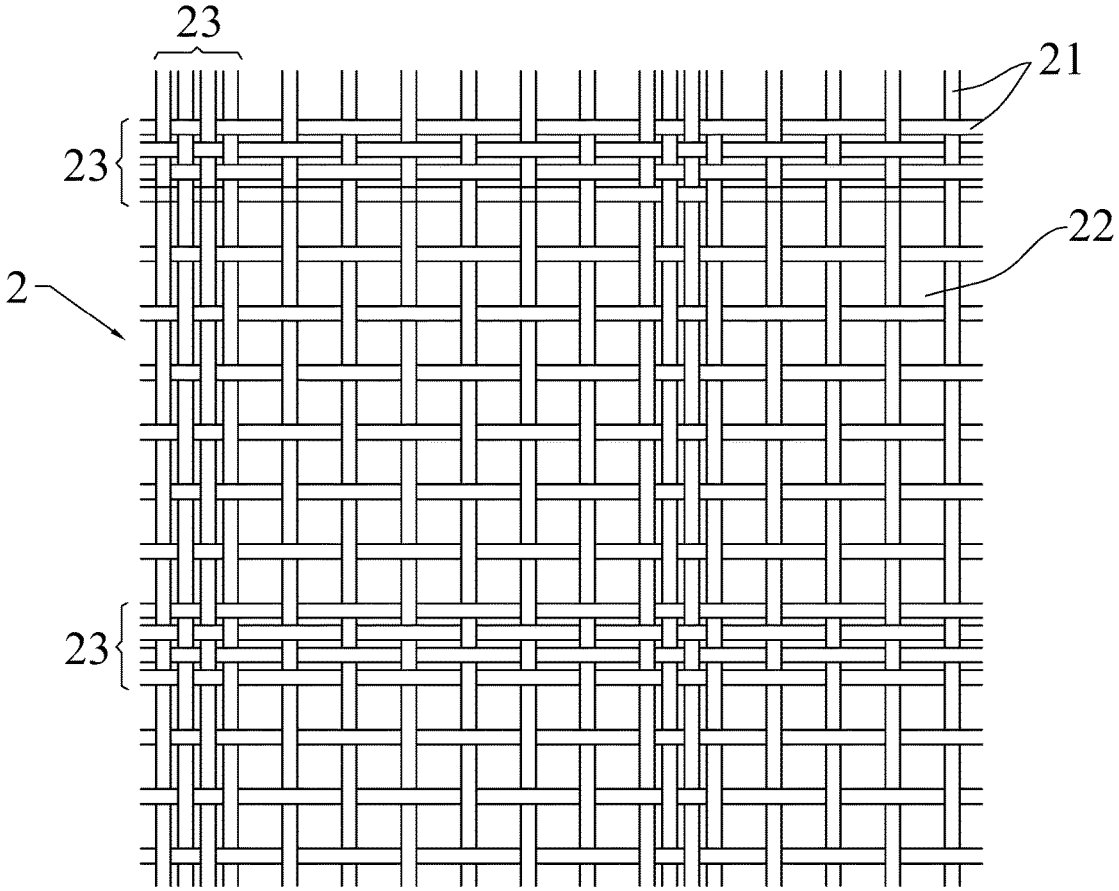
FIG. 5 is a structure diagram of a net-shaped fabric in accordance with one embodiment of the invention.

As shown in FIG. 5, the net-shaped fabric 2 comprises a warp and a weft 21, and the warp and the weft 21 are interwoven to form mesh openings 22. A diameter of the mesh openings 22 or a diameter of an inscribed circle of the mesh openings 22 is between 2 and 6 folds of a diameter of the warp or the weft 21. The diameter of the warp or the weft 21 is less than 0.55 mm. The diameter of the mesh openings 22 or the diameter of the inscribed circle of the mesh openings 22 is less than 1.5 mm. An area of an opening of each mesh opening 22 accounts for between 35% and 78% of a total area of the mesh opening 22. A thickness of the net-shaped fabric 2 is less than 1.1 mm. Interwoven strips 23 are formed on the net-shaped fabric 2 along the direction of the warp and/or the direction of the weft by congested warps or wefts. Each of the interwoven strips 23 comprises between 2 and 5 warps or wefts 21. The interwoven strips 23 are uniformly distributed on the net-shaped fabric 2 in a comb-like manner or a grid-like manner. A minimum space between two adjacent interwoven strips 23 is 3 mm, and a maximum space between two adjacent interwoven strips 23 is 50 mm. A surface of the interwoven strip 23 comprises grooves filled with waterproof adhesive.

Example 2

Figure 6:
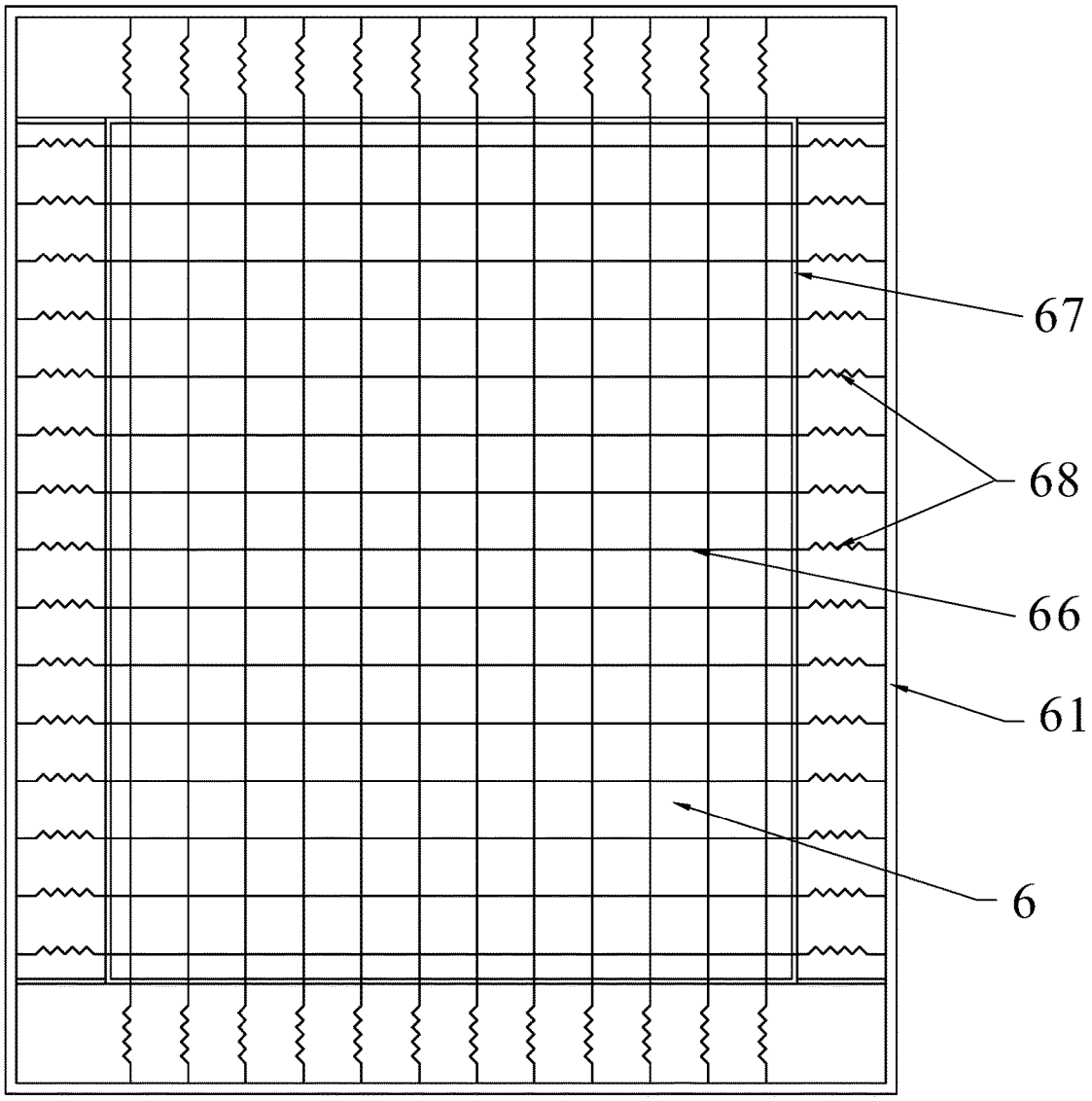
FIG. 6 is a structure diagram of an auxiliary load-bearing layer in accordance with one embodiment of the invention.

As shown in FIG. 6, stainless steel wires 66 are disposed on the auxiliary load-bearing frame 61 in parallel to the long side and short side of the auxiliary load-bearing frame 61, with an arrangement distance of between 5 and 60 mm. The stainless steel wires 66 pass through openings of the stop boards 67 to connect to one end of a spring 68, and the other end of the spring 68 is fixed on the auxiliary load-bearing frame 61. The stainless steel wires 66 are in sliding fit with the openings of the stop boards 67. The spring 68 cannot pass through the openings of the stop boards 67. The stainless steel wires 66, the spring 68, and the stop boards 67 combine to form a flexible connection and mutual positioning with the auxiliary load-bearing frame 61. The stretch length of the stainless steel wires 66 are negligible. The stretch length of the spring 68 is determined by the distance between the stop boards 67 and the auxiliary load-bearing frame 61. The stretch value of the spring 68 increases with the increase of the distance between the stop boards 67 and the auxiliary load-bearing frame 61. The stainless steel wires 66, the spring 68, and the stop boards 67 combine to form the auxiliary load-bearing layer 6.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A nursing bed, comprising:

a bed frame;

a net-shaped fabric;

a spray pipe;

a heat-insulation and water-draining bottom cover;

a base;

an auxiliary load-bearing layer, the auxiliary load-bearing layer comprising a grid support comprising a plurality of holes; and an auxiliary load-bearing frame;

wherein the heat-insulation and water-draining bottom cover is disposed at a lower part of the bed frame;

at least two edges of the net-shaped fabric are hung between two opposite edges of the bed frame to form a mutual positioning structure;

the auxiliary load-bearing layer is disposed beneath the net-shaped fabric;

the grid support comprises a grid supporting surface beneath the net-shaped fabric; a grid line width of the grid supporting surface is between 0.3 and 3 mm;

a diameter of an inscribed circle of the holes is between 5 and 60 mm;

the auxiliary load-bearing layer is disposed inside the auxiliary load-bearing frame and is located at an inner side of the bed frame via the auxiliary load-bearing frame;

the auxiliary load-bearing frame and the bed frame coordinate to form a spacing-adjustable positioning structure; and a distance between the net-shaped fabric and the grid supporting surface exceeds 15 mm in an empty load state.

2. The bed of claim 1, wherein the auxiliary load-bearing layer comprises a rigid body and an elastic body, and the plurality of holes of the auxiliary load-bearing layer are in the shape of an inverted cone.

3. The bed of claim 1, wherein an edge of the rigid body of the auxiliary load-bearing layer is provided with a hanging hole;

the auxiliary load-bearing frame is provided with a hanging column;

the auxiliary load-bearing layer is mounted on the hanging column of the auxiliary load-bearing frame via the hanging hole; and the hanging column of the auxiliary load-bearing frame is independently adjustable in a vertical direction relative to the auxiliary load-bearing frame, and a vertical displacement of the hanging column is less than or equal to 7 cm.

4. The bed of claim 2, wherein an edge of the rigid body of the auxiliary load-bearing layer is provided with a hanging hole;

the auxiliary load-bearing frame is provided with a hanging column;

the auxiliary load-bearing layer is mounted on the hanging column of the auxiliary load-bearing frame via the hanging hole; and the hanging column of the auxiliary load-bearing frame is independently adjustable in a vertical direction relative to the auxiliary load-bearing frame, and a vertical displacement of the hanging column is less than or equal to 7 cm.

5. The bed of claim 1, wherein the grid support of the auxiliary load-bearing layer comprises stainless steel wires equally spaced in length and breadth and stop boards; the stainless steel wires pass through openings of the stop boards to connect to one end of a spring, and the other end of the spring is fixed on the auxiliary load-bearing frame; a distance between the stop boards and the auxiliary load-bearing frame is adjustable, and the stop boards and the auxiliary load-bearing frame can be fixed in a preset position.

6. The bed of claim 1, wherein a maximum vertical displacement of the auxiliary load-bearing frame is less than or equal to 8 cm.

7. The bed of claim 2, wherein a maximum vertical displacement of the auxiliary load-bearing frame is less than or equal to 8 cm.

8. The bed of claim 5, wherein a maximum vertical displacement of the auxiliary load-bearing frame is less than or equal to 8 cm.

9. The bed of claim 1, wherein the net-shaped fabric comprises a warp and a weft, and the warp and the weft are interwoven to form mesh openings; a diameter of the mesh openings or a diameter of an inscribed circle of the mesh openings is between 2 and 6 folds of a diameter of the warp or the weft; the diameter of the warp or the weft is less than 0.55 mm; the diameter of the mesh openings or the diameter of the inscribed circle of the mesh openings is less than 1.5 mm; an area of an opening of each mesh opening accounts for between 35% and 78% of a total area of the mesh opening; a thickness of the net-shaped fabric is less than 1.1 mm.

10. The bed of claim 1, wherein the net-shaped fabric comprises a warp and a weft, and the warp and the weft are interwoven to form mesh openings;

interwoven strips are formed on the net-shaped fabric along a direction of the warp and/or a direction of the weft by congested warps or wefts;

each interwoven strip comprises between 2 and 5 warps or wefts;

the interwoven strips are uniformly distributed on the net-shaped fabric in a comb-shape or a grid-shape;

a minimum space between two adjacent interwoven strips is 3 mm, and a maximum space between two adjacent interwoven strips is 50 mm; and a surface of the interwoven strips comprises grooves filled with a waterproof adhesive.

11. The bed of claim 9, wherein interwoven strips are formed on the net-shaped fabric along a direction of the warp and/or a direction of the weft by congested warps or wefts;

each interwoven strip comprises between 2 and 5 warps or wefts;

the interwoven strips are uniformly distributed on the net-shaped fabric in a comb-shape or a grid-shape;

a minimum space between two adjacent interwoven strips is 3 mm, and a maximum space between two adjacent interwoven strips is 50 mm; and a surface of the interwoven strips comprises grooves filled with a waterproof adhesive.

12. The bed of claim 1, wherein a pipe slot is disposed on the bed frame or the auxiliary load-bearing frame;

the spray pipe is disposed between the net-shaped fabric and the auxiliary load-bearing layer and in the pipe slot; and the spray pipe is hidden inside the pipe slot in an idle state.

* * * * *